US009365961B2

(12) United States Patent
Lonati et al.

(10) Patent No.: US 9,365,961 B2
(45) Date of Patent: Jun. 14, 2016

(54) DOUBLE-CYLINDER CIRCULAR HOSIERY KNITTING MACHINE WITH DEVICE FOR TENSIONING THE MANUFACTURE

(75) Inventors: Ettore Lonati, Botticino (IT); Fausto Lonati, legal representative, Brescia (IT); Tiberio Lonati, Brescia (IT)

(73) Assignee: LONATI S.P.A., Brescia (IT)

( * ) Notice: Subject to any disclaimer, the term of this patent is extended or adjusted under 35 U.S.C. 154(b) by 50 days.

(21) Appl. No.: 14/345,292

(22) PCT Filed: Jul. 23, 2012

(86) PCT No.: PCT/EP2012/064423
§ 371 (c)(1),
(2), (4) Date: May 27, 2014

(87) PCT Pub. No.: WO2013/041269
PCT Pub. Date: Mar. 28, 2013

(65) Prior Publication Data

US 2014/0338401 A1 Nov. 20, 2014

(30) Foreign Application Priority Data

Sep. 19, 2011 (IT) ..... MI2011A1686

(51) Int. Cl.
*D04B 9/10* (2006.01)
*D04B 15/92* (2006.01)
(Continued)

(52) U.S. Cl.
CPC .. *D04B 9/10* (2013.01); *D04B 9/40* (2013.01); *D04B 9/46* (2013.01); *D04B 9/56* (2013.01); *D04B 15/92* (2013.01)

(58) Field of Classification Search
CPC ..... D04B 9/40; D04B 9/10; D04B 15/92
USPC ..... 66/149 S, 148
See application file for complete search history.

(56) References Cited

U.S. PATENT DOCUMENTS 3,738,123 A 6/1973 Mazzi
3,797,280 A 3/1974 Lonati
(Continued)

FOREIGN PATENT DOCUMENTS

CN 1561416 1/2005
EP 0516049 12/1992
(Continued)

OTHER PUBLICATIONS

Chinese Search Report and translation dated Jan. 23, 2015, for Pat No. 201280045457.3.
(Continued)

*Primary Examiner* — Danny Worrell
(74) *Attorney, Agent, or Firm* — Husch Blackwell LLP

(57) ABSTRACT

A double-cylinder circular hosiery knitting machine with device for tensioning the manufacture during its production, comprising a supporting structure which is provided with a footing and supports, so as to allow rotation about its own vertically oriented axis, a lower needle cylinder and an upper needle cylinder, a device for tensioning the manufacture during its production is accommodated inside the needle cylinders and comprises elements for retaining the manufacture, the retention elements comprising a suction tube, which is accommodated internally and coaxially to the lower needle cylinder, and an element for locking the manufacture, which faces the upper end of the suction tube and is supported by the upper needle cylinder, the locking element being movable on command along the axis of the upper needle cylinder to engage or disengage the upper end of the suction tube.

8 Claims, 8 Drawing Sheets

(51) Int. Cl.

| | |
|---|---|
| ***D04B 9/40*** | (2006.01) |
| ***D04B 9/56*** | (2006.01) |
| ***D04B 9/46*** | (2006.01) |

(56) References Cited

U.S. PATENT DOCUMENTS

| | | | | |
|---|---|---|---|---|
| 4,142,384 | A | 3/1979 | Wood | |
| 4,516,410 | A * | 5/1985 | Lonati | 66/14 |
| 4,945,734 | A | 8/1990 | Maruyama | |
| 5,235,825 | A * | 8/1993 | Turini | 66/149 S |
| 6,164,091 | A * | 12/2000 | Frullini et al. | 66/148 |
| 6,698,250 | B2 * | 3/2004 | Lonati et al. | 66/149 S |
| 7,975,513 | B2 * | 7/2011 | Lonati et al. | 66/148 |
| 2003/0233852 | A1 * | 12/2003 | Lonati et al. | 66/17 |
| 2005/0115279 | A1 | 6/2005 | Magni | |

FOREIGN PATENT DOCUMENTS

| | | | |
|---|---|---|---|
| EP | 0 727 516 | A1 | 8/1996 |
| EP | 1 375 719 | A1 | 1/2004 |

OTHER PUBLICATIONS

International Search Report and Written Opinion for related PCT Patent App. No. PCT/EP2012/064423 dated Nov. 29, 2012.

Search Report and Written Opinion for related Italian Patent App. No. IT M120111686 dated Jul. 24, 2012.

* cited by examiner

DOUBLE-CYLINDER CIRCULAR HOSIERY KNITTING MACHINE WITH DEVICE FOR TENSIONING THE MANUFACTURE

The present invention relates to a double-cylinder circular hosiery knitting machine with device for tensioning the manufacture.

As is known, double-cylinder circular hosiery knitting machines are generally provided with a device for tensioning the manufacture during its production.

EP-727.516 in the name of the same Applicant discloses a double-cylinder circular hosiery knitting machine provided with a device for tensioning the manufacture during its production which comprises means for retaining the manufacture proximate to the region where knitting is formed by the needles of the machine and a tensioning tube, which is accommodated in the upper needle cylinder and can move on command along the axis of the upper needle cylinder. The lower end of the tensioning tube can engage, by sliding along the axis of the upper needle cylinder, the region of the manufacture being formed that lies from the retention means to the needles. The tensioning tube is sized so as to be able to slide externally around the retention means, translating along the axis of the needle cylinders, which are arranged coaxially.

The retention means disclosed in this patent are constituted substantially by a suction tube, which is accommodated inside the upper needle cylinder and faces, with its lower end, the lower needle cylinder, and by a locking element, which is supported inside the lower needle cylinder so that it can slide along the axis of the lower needle cylinder and can move on command along said axis to engage or disengage with respect to the lower end of the suction tube, so as to block the manufacture, during its formation, aspirated into the suction tube.

The tensioning tube can move along the common axis of the needle cylinders thanks to the action of a double-acting fluid-operated cylinder, which can be supplied with a pressurized fluid whose pressure can be varied so as to vary the force applied by the tensioning tube to the manufacture.

In practice, as disclosed in EP-727.516, during the formation of the manufacture an initial portion of the manufacture is aspirated into the suction tube and locked by means of the locking element. Then the tensioning tube, previously accommodated inside the upper needle cylinder, is lowered progressively thanks to the action of the double-acting fluid-operated cylinder so as to engage, with its lower end, the portion of the manufacture that lies from the suction tube to the needles and so as to descend inside the lower needle cylinder, tensioning the manufacture with a force which depends on the supply pressure of the double-acting fluid-operated cylinder. At the end of the formation of the manufacture, the tensioning tube is again retracted into the upper needle cylinder while the manufacture is aspirated into the suction tube and then abandoned by the needles in order to be removed, by way of the same suction tube, from the machine.

In recent years, particularly in the field of hosiery, the demand has increased for automated systems capable of picking up the hosiery item, at the end of its production, from the machine that produced it and of transferring it to a sewing or looping station, generally arranged laterally to said machine, in which a sewing head is provided which can be actuated to close the toe of the hosiery item. These automated systems have been used widely in single-cylinder circular hosiery knitting machines and used less in double-cylinder circular hosiery knitting machines due to a plurality of difficulties which are mainly due to the more complex structure of double-cylinder circular machines.

WO2009/112346 in the name of the same Applicant discloses an apparatus and a method for closing a knitted tubular manufacture at one of its axial ends, at the end of its production cycle on a circular hosiery knitting machine or the like. This method substantially consists in removing the manufacture, at the end of its production, from the needles of the machine by means of a pick-up device and in transferring the manufacture to a region arranged laterally to the needle cylinder of the machine in which a handling device, which receives the manufacture from the pick-up device and moves mutually adjacent the two flaps of the axial end of the manufacture to be closed, and a sewing head, which joins these two flaps, thus closing the axial end of the manufacture, are provided.

The pick-up device, which is disclosed in said international patent application and is the subject of WO 2009/112347, comprises an annular body which can be positioned coaxially around the upper end of the needle cylinder of a single-cylinder circular hosiery knitting machine and supports, inside radial slots, pick-up elements which can move on command radially and can each engage, by virtue of their end directed toward the axis of the annular body, the stem of a needle of the machine, below the latch, so as to receive, in said end, which is shaped like a hook with the tip directed upward, the last loop of knitting of the manufacture formed by said needle when it is pushed downward below the latch. The subsequent upward movement of the pick-up device causes the closure of the latches on the heads of the needles and the disengagement of the manufacture from the needles of the machine.

In double-cylinder circular machines, said pick-up device can be positioned, theoretically, around the upper end of the lower needle cylinder, so as to pick up the loops of the last row of knitting formed by the needles and retained by said needles previously transferred or held in the lower needle cylinder.

The practical application of this pick-up device to double-cylinder circular hosiery knitting machines has encountered a plurality of difficulties, which include the presence of the device for tensioning the manufacture during its production, as described above, since at the end of production the manufacture is aspirated into the upper needle cylinder, making it impossible to arrange a pick-up device of the type described above around the upper end of the lower needle cylinder.

The aim of the present invention is to provide a double-cylinder circular hosiery knitting machine with a device for tensioning the manufacture during its production which allows, in a simple manner, an automated pick-up of the manufacture from the machine at the end of its production by means of a pick-up device provided with pick-up elements which can engage the stem of the needles, arranged in the lower needle cylinder, below the upper latch of said needles.

Within this aim, an object of the invention is to provide a double-cylinder circular hosiery knitting machine with a device for tensioning the manufacture which can cooperate in the positioning of the manufacture with respect to the needles in preparation for the operation for automated pick-up.

Another object of the invention is to provide a machine with a manufacture tensioning device that allows in any case to adjust the force with which the manufacture is tensioned during its production.

Another object of the invention is to provide a machine with a manufacture tensioning device that offers the greatest assurances of safety and reliability in use.

This aim and these and other objects which will become better apparent hereinafter are achieved by a double-cylinder circular hosiery knitting machine with device for tensioning the manufacture during its production, comprising a supporting structure which is provided with a footing for resting on the ground and supports, so that it can rotate about its own vertically oriented axis, a lower needle cylinder and an upper needle cylinder which can be positioned, during the production of the manufacture, above and coaxially with respect to said lower needle cylinder; said lower needle cylinder and said upper needle cylinder being actuatable with a rotary motion about their axes with respect to said supporting structure; a device for tensioning the manufacture during its production being accommodated inside said needle cylinders; said device for tensioning the manufacture comprising means for retaining the manufacture proximate to the region where knitting is formed by the needles accommodated in said needle cylinders and a tensioning tube, which is accommodated in said upper needle cylinder and is movable on command along the axis of said upper needle cylinder; the lower end of said tensioning tube being engageable, by sliding along the axis of said upper needle cylinder, with the region of the manufacture being formed that lies from said retention means to the needles; said retention means having a size suitable to allow the movement of said tensioning tube about said retention means, means for the translational motion of said tensioning tube along the axis of said upper needle cylinder being provided, characterized in that said retention means comprise a suction tube, which is accommodated internally and coaxially to said lower needle cylinder, and an element for locking the manufacture, which faces the upper end of said suction tube and is supported by said upper needle cylinder, said locking element being movable on command along the axis of said upper needle cylinder to engage or disengage the upper end of said suction tube.

Further characteristics and advantages of the invention will become better apparent from the description of a preferred but not exclusive embodiment of the machine according to the invention, illustrated by way of nonlimiting example in the accompanying drawings, wherein.

Figure 1:
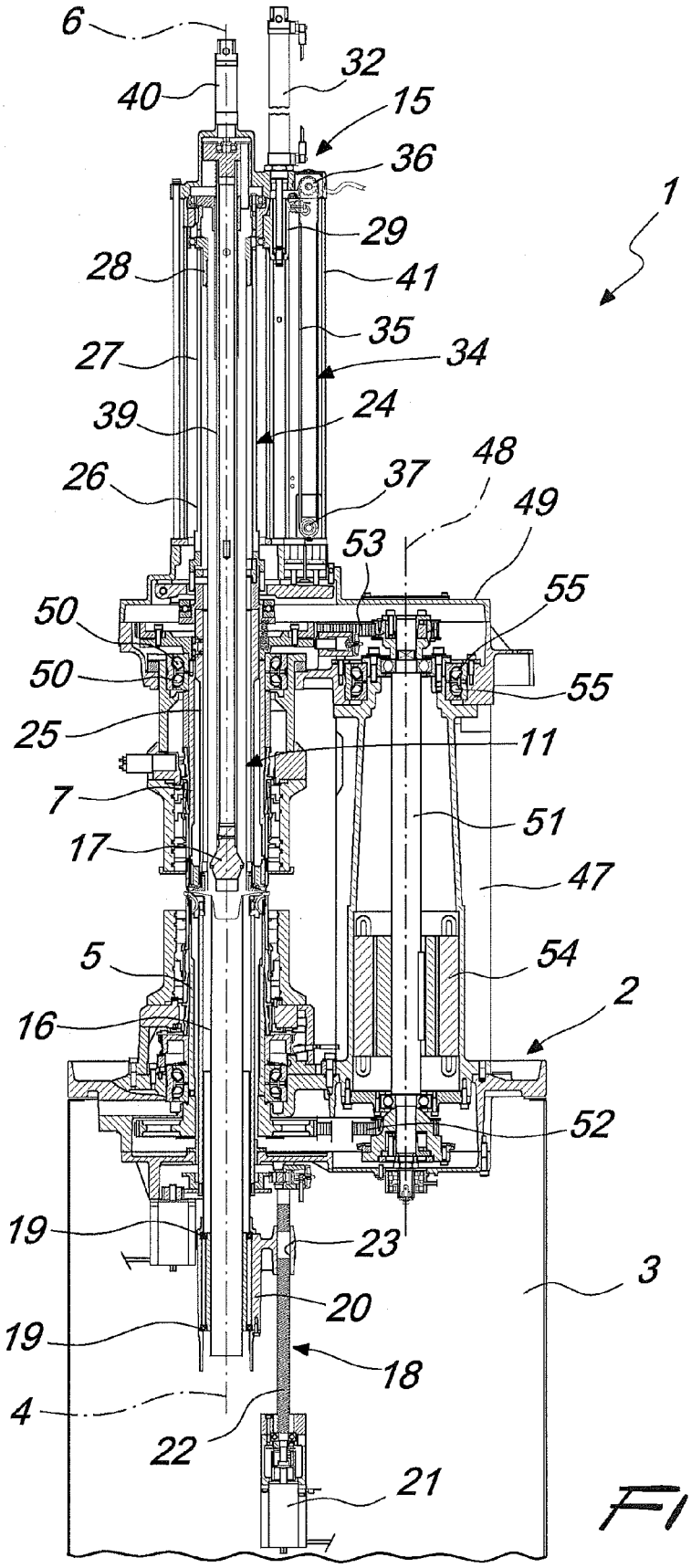
FIG. 1 is a schematic axial sectional view of the machine according to the invention at the beginning of the formation of a manufacture.
Figure 2:
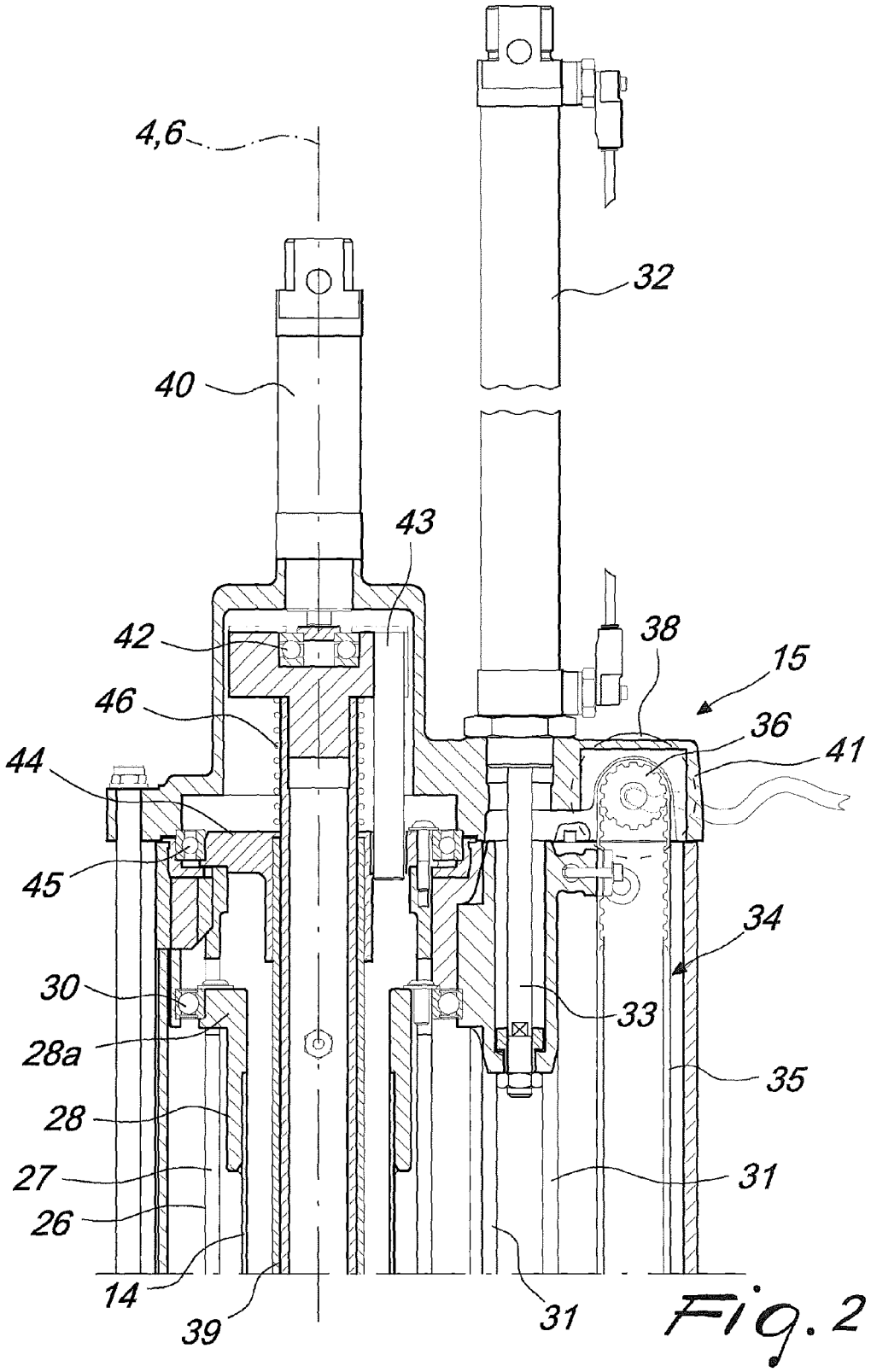
FIG. 2 is an enlarged-scale view of a detail of FIG. 1.

With reference to the figures, the machine according to the invention, generally designated by the reference numeral 1, comprises a supporting structure 2 which comprises, in a per se known manner, a footing 3 for resting on the ground which supports, so that it can rotate about its vertically oriented axis 4, a lower needle cylinder 5. The supporting structure 2 supports, furthermore, so that it can rotate about the corresponding axis 6, an upper needle cylinder 7, which is arranged above the lower needle cylinder 5 and can be positioned coaxially to said lower needle cylinder 5.

The lower needle cylinder 5 and the upper needle cylinder 7 have, on their lateral surface, a plurality of axial slots 8, 9. When the upper needle cylinder 7 is arranged coaxially to the lower needle cylinder 5, the axial slots 9 of the upper needle cylinder 7 are aligned with the axial slots 8 of the lower needle cylinder 5. Each pair of axial slots 8, 9, composed of an axial slot 8 defined in the lower needle cylinder 5 and the axial slot 9 aligned therewith and defined in the upper needle cylinder 7, accommodates a needle 10 provided typically with two heads 10*a*, 10*b* at its ends, respectively an upper head 10*a* and a lower head 10*b*. The heads 10*a*, 10*b* of the needle 10 are hook-shaped, so as to take the yarn supplied at a feed or drop of the machine to produce knitting.

Depending on the knitting requirements, the needle 10 can be translated in the lower needle cylinder 5 and can form knitting by means of its upper head 10*a* or in the upper needle cylinder 7 and can form knitting by means of its lower head 10*b*. The needles 10 of the machine can be actuated, in a per se known manner, with an alternating motion along the axial slots 8, 9 of the lower needle cylinder 5 or of the upper needle cylinder 7 so as to take the yarn or yarns provided at a feed or drop of the machine and so as to form knitting.

A device 11 for tensioning the knitted manufacture 12 during its formation is accommodated inside the needle cylinders 5, 7.

The device 11 for tensioning the manufacture 12 comprises means 13 for retaining the manufacture 12 proximate to the knitting forming region, i.e., the region at which the lower needle cylinder 5 faces the upper needle cylinder 7 which is coaxial thereto, and a tensioning tube 14, which is accommodated in the upper needle cylinder 7 and can move on command along the axis 6 of the upper needle cylinder 7.

The lower end of the tensioning tube 14 can engage, thanks to its sliding along the axis 6 of the upper needle cylinder 7, the region of the manufacture 12 being formed that lies from the retention means 13 to the needles 10. The retention means 13 have a size suitable to allow the movement of the tensioning tube 14 along the axis 6 of the upper needle cylinder 7 about said retention means 13. The tensioning tube 14 is moved along the axis 6 of the upper needle cylinder 7 by corresponding translation means 15.

According to the invention, the retention means 13 comprise a suction tube 16, which is accommodated internally and coaxially to the lower needle cylinder 5, and an element 17 for locking the manufacture 12, which faces the upper end of the suction tube 16 and is supported by the upper needle cylinder 7. The locking element 17 is movable on command along the axis 6 of the upper needle cylinder 7 to engage or disengage the upper end of the suction tube 16.

Preferably, the suction tube 16 is supported, so that it can slide along its axis, which coincides with the axis 4, by the lower needle cylinder 5, and means 18 are provided for the translation of the suction tube 16 along its axis 4 with respect to the lower needle cylinder 5.

More particularly, the suction tube 16 is integral with the lower needle cylinder 5 as regards rotation about its axis 4 and is supported, so that it can slide along its axis 4, by the lower needle cylinder 5. The suction tube 16 exits, with its lower end, from the lower end of the lower needle cylinder 5. The portion of the lower end of the suction tube 16 that exits downward from the lower needle cylinder 5 is connected, thanks to the interposition of a pair of bearings 19, inside a sleeve 20.

The means 18 for the translation of the suction tube 16 along its own axis 4 with respect to the lower needle cylinder 5 are constituted preferably by an electric motor 21, for example a step motor, which is connected by means of its body to the footing 3 of the supporting structure 2 and is connected, by means of its shaft, to a threaded shaft 22, which is oriented so as to be parallel to the axis 4 of the lower needle cylinder 5 and mates with a female thread 23 defined in a lateral expansion of the sleeve 20.

By means of the actuation of the electric motor 21, as a consequence of the screw-and-nut coupling between the threaded shaft 22 and the sleeve 20, it is possible to produce the upward or downward translation of the sleeve 20 and therefore of the suction tube 16 along the axis 4 of the lower needle cylinder 5 with respect to said lower needle cylinder 5. In particular, by way of the actuation of the electric motor 21 it is possible to move the suction tube 16 from a lowered position, in which it is arranged so that its upper end is below the upper end of the lower needle cylinder 5, to a raised position, in which it protrudes with its upper end from the upper end of the lower needle cylinder 5, and vice versa, as well as in any intermediate positions.

The tensioning tube 14 is accommodated coaxially, and so that it can slide axially, inside a guiding cylinder 24, which is fixed coaxially inside the upper needle cylinder 7.

More particularly, the guiding cylinder 24 is composed of two parts, respectively: a lower part 25, which is fixed to the inner surface of the upper needle cylinder 7, and an upper part 26, which is fixed integrally to the upper end of the lower part 25 and exits upward from the upper needle cylinder 7. Both the lower part 25 and the upper part 26 have a substantially cylindrical hollow shape which is open at the end faces.

The upper part 26 of the guiding cylinder 24 has a plurality of axial slots 27, which pass through its lateral surface. The upper end of the tensioning tube 14 is fixed coaxially to a cylinder 28, which has a plurality of teeth 28*a* which pass, so as to allow axial sliding, through said axial slots 27 and connect the cylinder 28 to a block 29 which is arranged laterally to the upper part 26 of the guiding cylinder 24. A bearing 30 is interposed between the teeth 28*a* of the cylinder 28 and said block 29 so that the cylinder 28, the tensioning tube 14 and the guiding cylinder 24 rotate integrally with the upper needle cylinder 7 about its axis 6, while the block 29, despite being integral with the cylinder 28 and therefore with the tensioning tube 14 in translation along the axis 6 of the upper needle cylinder 7, is not affected by the rotation of the upper needle cylinder 7.

The block 29 is supported, so that it can slide along a direction which is parallel to the axis 6 of the upper needle cylinder 7, within corresponding guides 31, which are connected to the supporting structure 2 and run parallel to the axis 6 of the upper needle cylinder 7 laterally to the upper part 26 of the guiding cylinder 24.

The translation means 15 of the tensioning tube 14 comprise a first double-acting fluid-operated cylinder 32, which is connected by means of its body to the supporting structure 2 and is arranged so that the stem 33 of its piston is oriented parallel to the axis 6 of the upper needle cylinder 7. The stem 33 of the first fluid-operated cylinder 32 is connected to the block 29 and the first fluid-operated cylinder 32 can be supplied with a pressurized fluid so as to cause the movement of the block 29 along the guides 31 to actuate the lifting or lowering of the tensioning tube 14 along the axis 6 of the upper needle cylinder 7.

The supply pressure of the first fluid-operated cylinder 32 is adjustable, in a manner which is similar to what is disclosed in EP-727.516, so as to vary the degree of tension applied to the manufacture 12 by means of the tensioning tube 14.

Conveniently, means 34 are provided for detecting the movement of the tensioning tube 14 along the axis 6 of the upper needle cylinder 7.

The detection means 34 comprise a toothed belt 35 which connects to each other two pulleys 36, 37, which are supported, so that they can rotate about the corresponding axes, by the supporting structure 2 of the machine. The axes of the pulleys 36, 37 are mutually parallel and are arranged at right angles to the axis 6 of the upper needle cylinder 7, so that the two portions of the toothed belt 35 that connect to each other these pulleys 36, 37 are parallel to the axis 6 of the upper needle cylinder 7, i.e. vertical. One of these two portions is connected to the block 29 and the pulley 36 is connected to an encoder 38 by means of which the rotation of the pulley 36 induced by the movement of the block 29, actuated by the first fluid-operated cylinder 32, is detected, and thus the movement of the tensioning tube 14 along the axis 6 of the upper needle cylinder 7 is detected with high precision.

The locking element 17 is plug-shaped, with a lower portion which has a smaller diameter than the inside diameter of the upper end of the suction tube 16, so that said lower portion can be inserted within the upper end of the suction tube 16. An intermediate portion of the locking element 17 has a larger diameter than the inside diameter of the upper end of the suction tube 16, so that the locking element 17 can rest with this intermediate portion against the upper end, i.e., against the inlet, of the suction tube 16. The larger outside diameter of the locking element 17 is smaller than the inside diameter of the tensioning tube 14 so as to avoid hindering the movement of the tensioning tube 14 along the axis 6 of the upper needle cylinder 7.

The locking element 17 is fixed to the lower end of an internally hollow shaft, which is arranged internally and coaxially to the upper needle cylinder 7 and exits from the upper end of the upper needle cylinder 7.

The shaft 39 passes through the cylinder 28 and protrudes upwardly from the guiding cylinder 24 with its upper end, which is connected to the stem of the piston of a second fluid-operated cylinder 40. This second fluid-operated cylinder 40 is connected, by means of its body, to an enclosure 41, which is fixed to the supporting structure 2 of the machine and also supports the first fluid-operated cylinder 32. A bearing 42 is interposed between the stem of the piston of the second fluid-operated cylinder 40 and the upper end of the shaft 39 so that the shaft 39 can rotate integrally with the upper needle cylinder 7 about its axis 6 without involving in the rotation the stern of the second fluid-operated cylinder 40. The shaft 39, at its upper end, is rendered integral, in rotation about its axis 6, with the guiding cylinder 24 by means of a shaft 43, which is fixed to the upper end of the shaft 39 and is oriented parallel to the axis 6 of the upper needle cylinder 7. This shaft 43 passes slidingly through a hole which passes through a cover 44 which is fixed so as to close the upper end of the guiding cylinder 24. A bearing 45 is interposed between the cover 44 and the enclosure 41, and the enclosure 41 supports, by means of said bearing, so as to allow rotation about its axis 6, the guiding cylinder 24 at its upper end. The second fluid-operated cylinder 40 is of the single-acting type with downward actuation and a return spring 46 is provided, which is interposed between a shoulder defined along the shaft 39, proximate to its upper end, and the cover 44.

The supporting structure 2 of the machine, in addition to the footing 3, comprises a column 47 which rises from the footing 3 and supports, so that it can rotate about an axis 48 which is parallel and spaced with respect to the axis 4 of the lower needle cylinder 5, an arm 49, which in turn, by means of a pair of bearings 50, supports the upper needle cylinder 7 so that it can rotate about its own axis 6. The enclosure 41 is fixed to the arm 49.

Inside the column 47 a main shaft 51 is provided, the axis of which defines the axis 48 and which, by means of a connection with toothed belts 52, 53, as shown, or with gears, mutually connects the lower needle cylinder 5 and the upper needle cylinder 7 in rotation about the corresponding axes 4, 6.

Preferably, the main shaft 51 is constituted by the shaft of an electric motor 54, which is accommodated inside the column 47 and constitutes the actuation motor of the lower needle cylinder 5 and of the upper needle cylinder 7. The arm 49 is supported by the column 47, so that it can rotate about the axis 48 of the main shaft 51, by means of bearings 55 and can rotate with respect to the column 47 about the axis 48 of the main shaft 51, so as to move the upper needle cylinder 7 from an active position, in which it is arranged above and coaxially to the lower needle cylinder 5, to an inactive position, in which it is arranged laterally to the lower needle cylinder 5.

With the upper needle cylinder 7 in the inactive position, it is possible to arrange around the upper end of the lower needle cylinder 5 a pick-up element, for example of the type disclosed in WO2009/112346 and WO2009/112347, to perform the automated pick-up of the manufacture 12 from the machine at the end of its production, as described in said international patent applications and in a copending patent application in the name of the same Applicant.

Operation of the machine with device for tensioning the manufacture during its production, according to the invention, is as follows.

At the beginning of the production of the manufacture 12, the suction tube 16 is arranged with its upper end just below the upper end of the lower needle cylinder 5. The locking element 17 is disengaged from the upper end of the suction tube 16 and is raised with respect to it.

The suction tube 16 is connected, by means of its lower end, to a suction device, of a type which is known and not shown for the sake of simplicity, so that a partial vacuum is generated inside it which causes air suction through its upper end.

Figure 3:
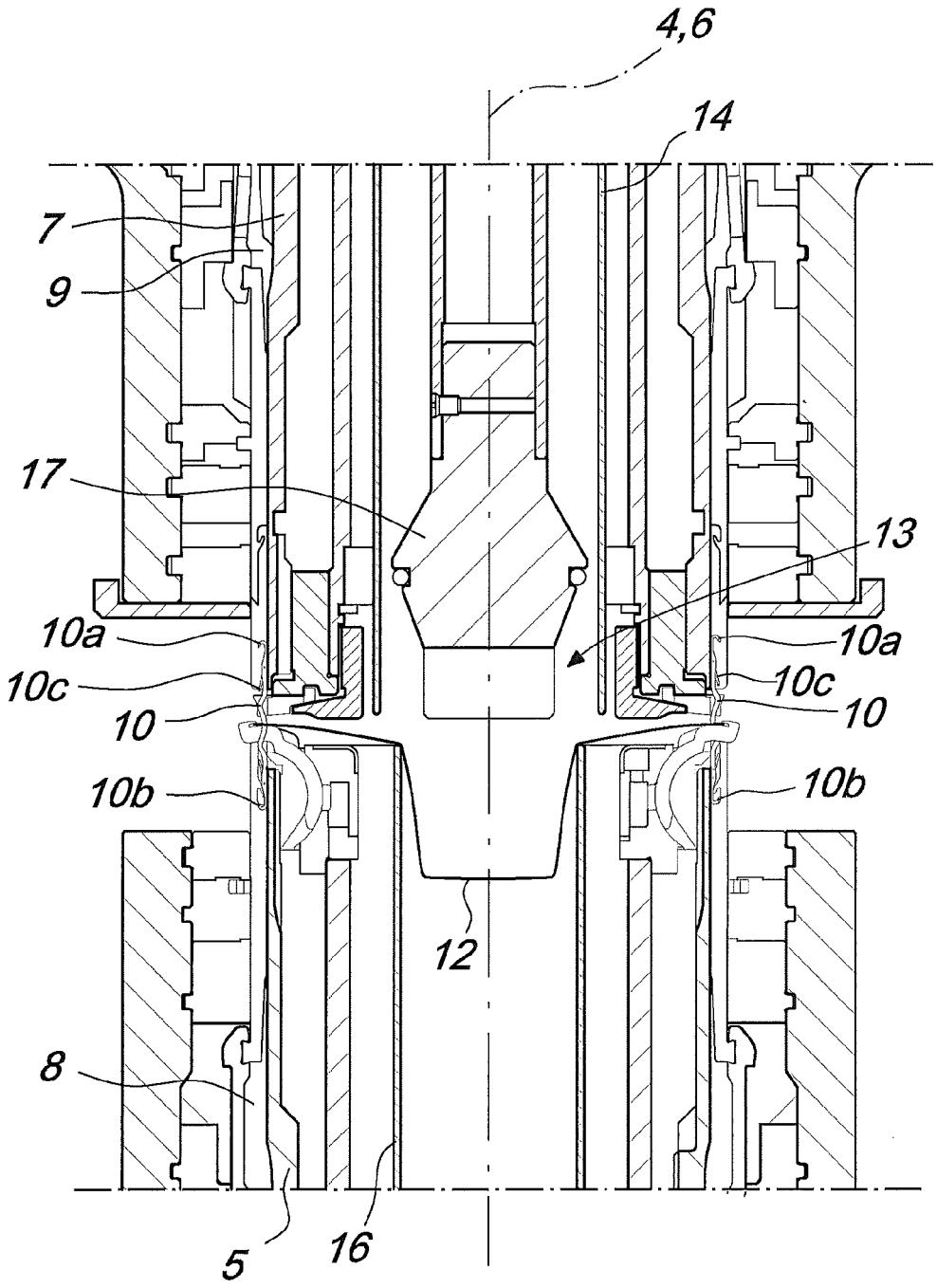
FIG. 3 is an enlarged-scale view of another detail of FIG. 1.

After the machine has started to form a first portion of the manufacture 12, said first portion of the manufacture 12, due to the air suction, is aspirated into the upper end of the suction tube 16, as shown in FIGS. 1 and 3.

At this point, by means of the actuation of the second fluid-operated cylinder 40, the locking element 17 is lowered so that it engages the upper end of the suction tube 16, locking the initial portion of the manufacture 12 inserted within the suction tube 16.

Figure 4:
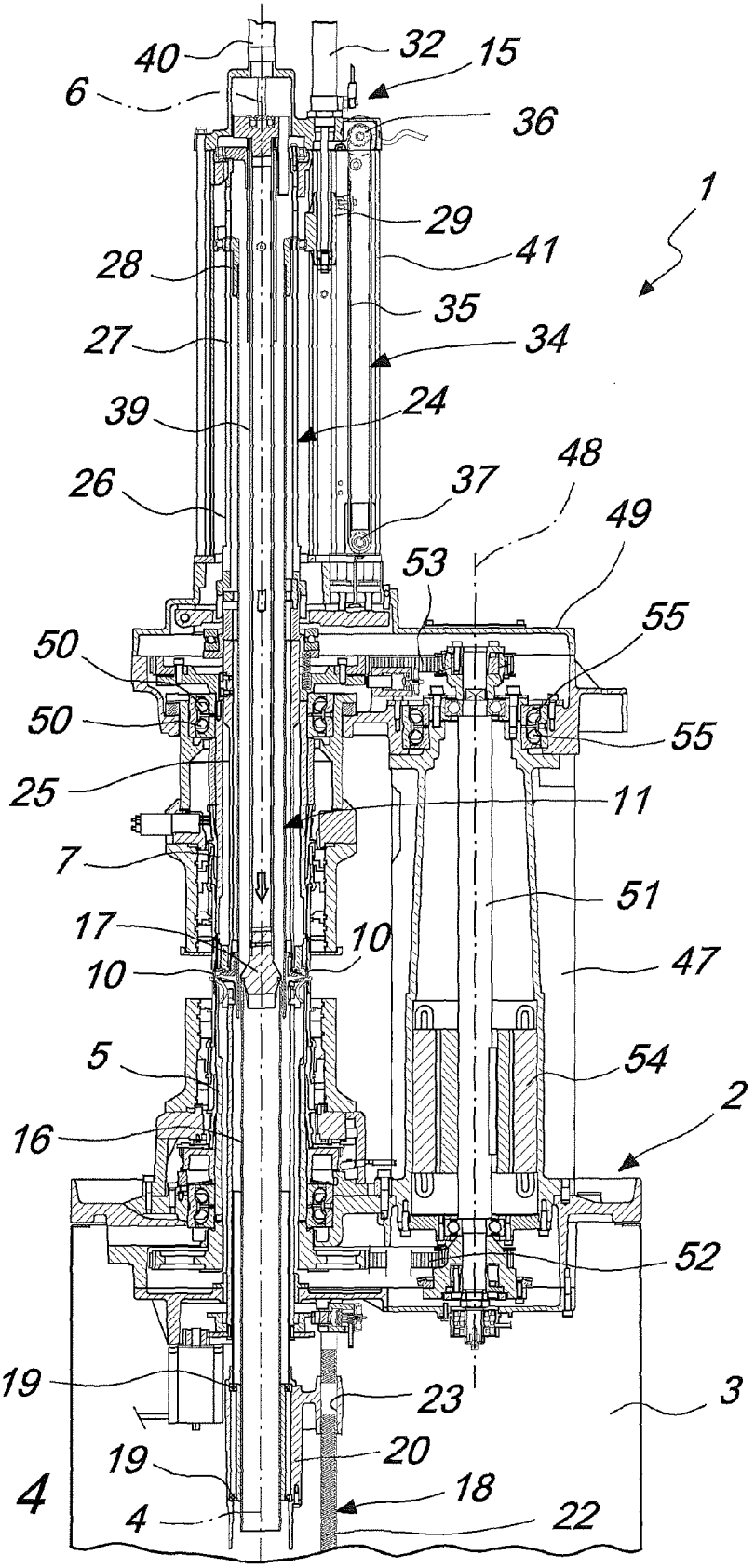
FIG. 4 is a sectional view of the machine, as in FIG. 1, during the production of the manufacture.
Figure 5:
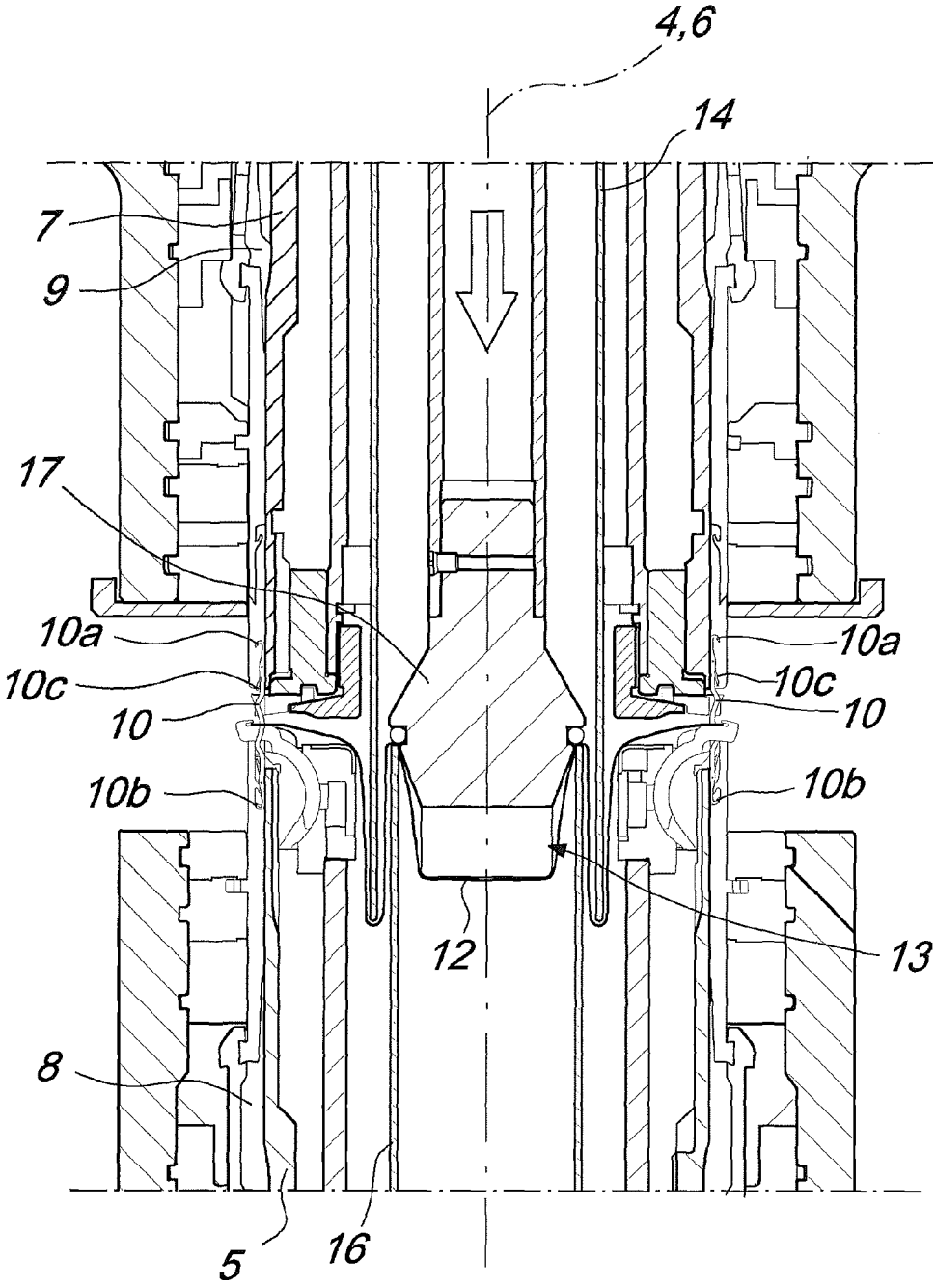
FIG. 5 is an enlarged-scale view of a detail of FIG. 4.

During the production of the manufacture 12, thanks to the actuation of the first fluid-operated cylinder 32, the tensioning tube 14 is progressively lowered inside the lower needle cylinder 5 and engages, by means of its lower end, the portion of the manufacture 12 that lies from the upper end of the suction tube 16 to the needles 10 of the machine, as shown in FIGS. 4 and 5.

It should be noted that the force with which the manufacture 12 is tensioned during its forming can be changed by varying the supply pressure of the first fluid-operated cylinder 32, in a manner similar to what is disclosed in EP-727.516. Moreover, by means of the encoder 38 it is possible to control the progressive lowering of the tensioning tube 14 and therefore it is also possible to control the length of the manufacture 12 during its forming.

At the end of the production of the manufacture 12, the locking element 17, thanks to the deactivation of the second fluid-operated cylinder 40 and as a consequence of the elastic reaction of the spring 46, is disengaged and spaced upwardly from the upper end of the suction tube 16, while by means of the actuation in the opposite direction of the first fluid-operated cylinder 32 the tensioning tube 14 is lifted progressively.

Figure 6:
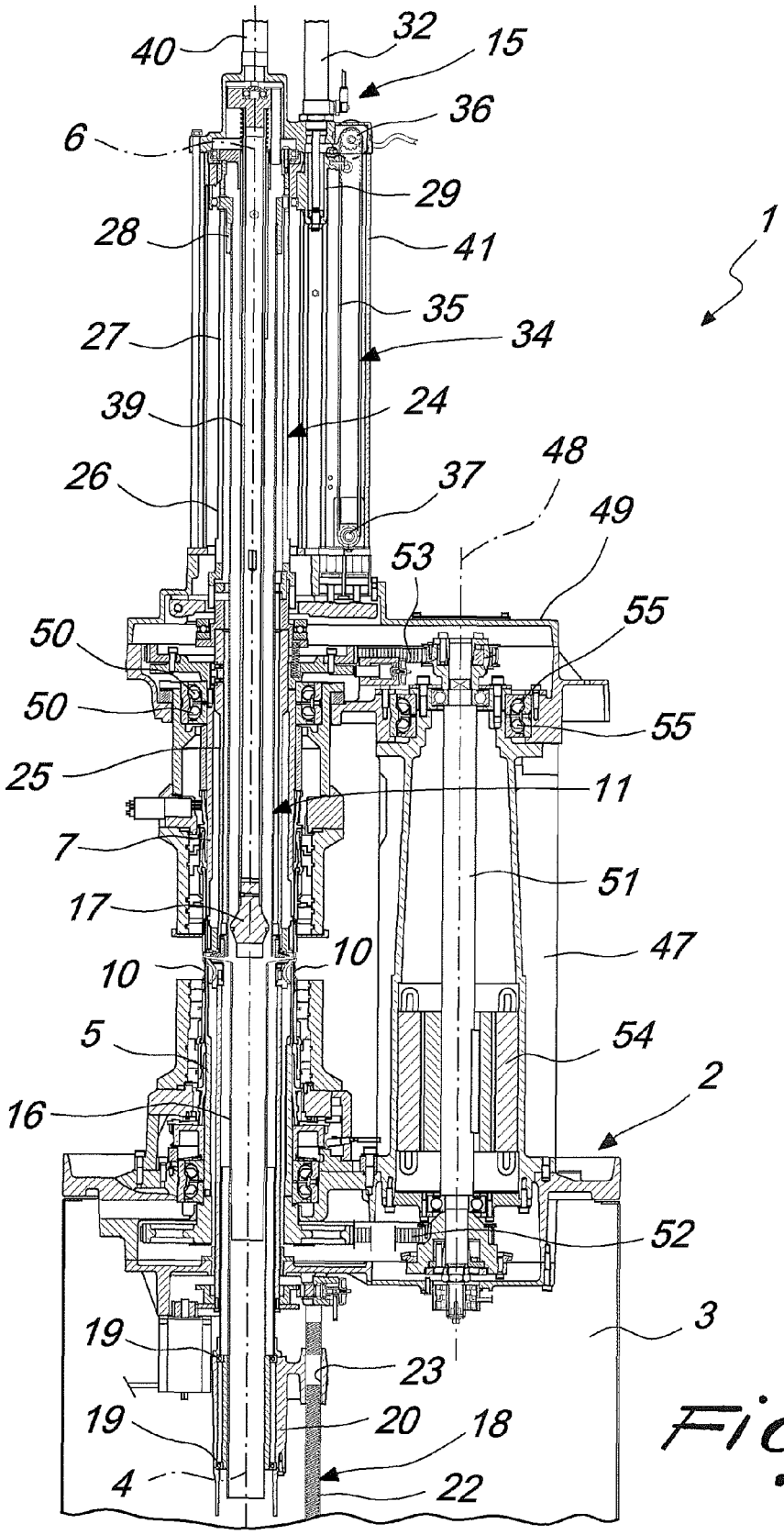
FIG. 6 is a sectional view of the machine, as in FIG. 1, at the end of the production of the manufacture.
Figure 7:
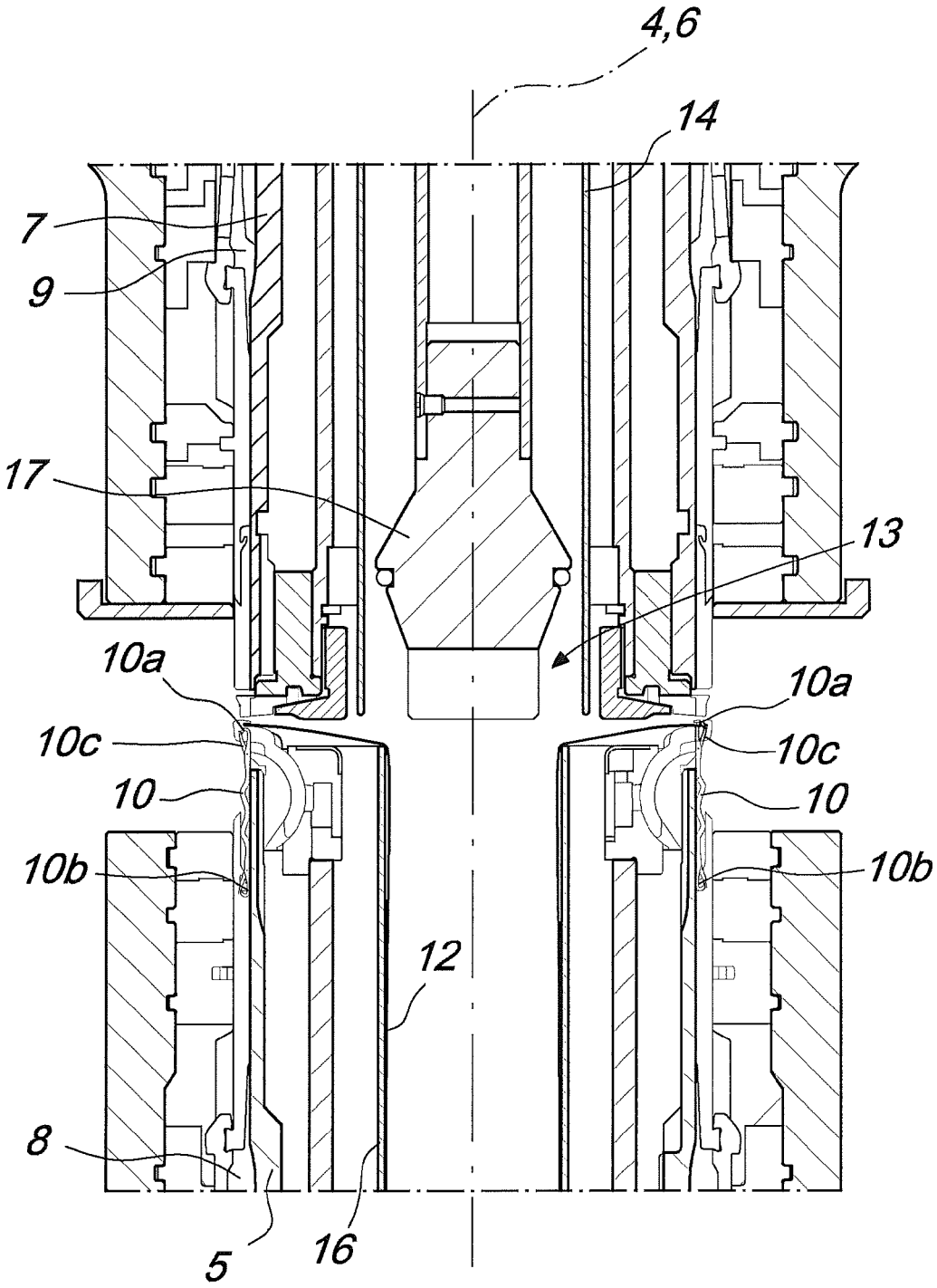
FIG. 7 is an enlarged-scale view of a detail of FIG. 6.

In this step, as a consequence of the suction applied inside the suction tube 16, the manufacture 12 is aspirated progressively into said suction tube 16, as shown in FIGS. 6 and 7.

Depending on the requirements, the manufacture 12 can be moved away from the machine through the suction tube 16 simply by ending the production of the manufacture 12 and disengaging it, in a per se known manner, from the needles 10 of the machine, or can be retained on the needles 10 of the machine to be picked up from the machine in an automated manner and be subjected to other works, such as for example an operation for the automated closure of an axial end, for example the tip if the manufacture 12 is a hosiery item.

In the second case, if a pick-up device of the type disclosed in WO2009/112346 and WO2009/112347 is used, the suction tube 16, after the needles 10 have been lowered into the upper needle cylinder 5 with the last formed loop of knitting engaged in the upper head 10*a* and the upper needle cylinder 7 has been moved to the inactive position laterally to the lower needle cylinder 5, it can be used to assist the operation of preparation for pick-up of the manufacture 12.

Figure 8:
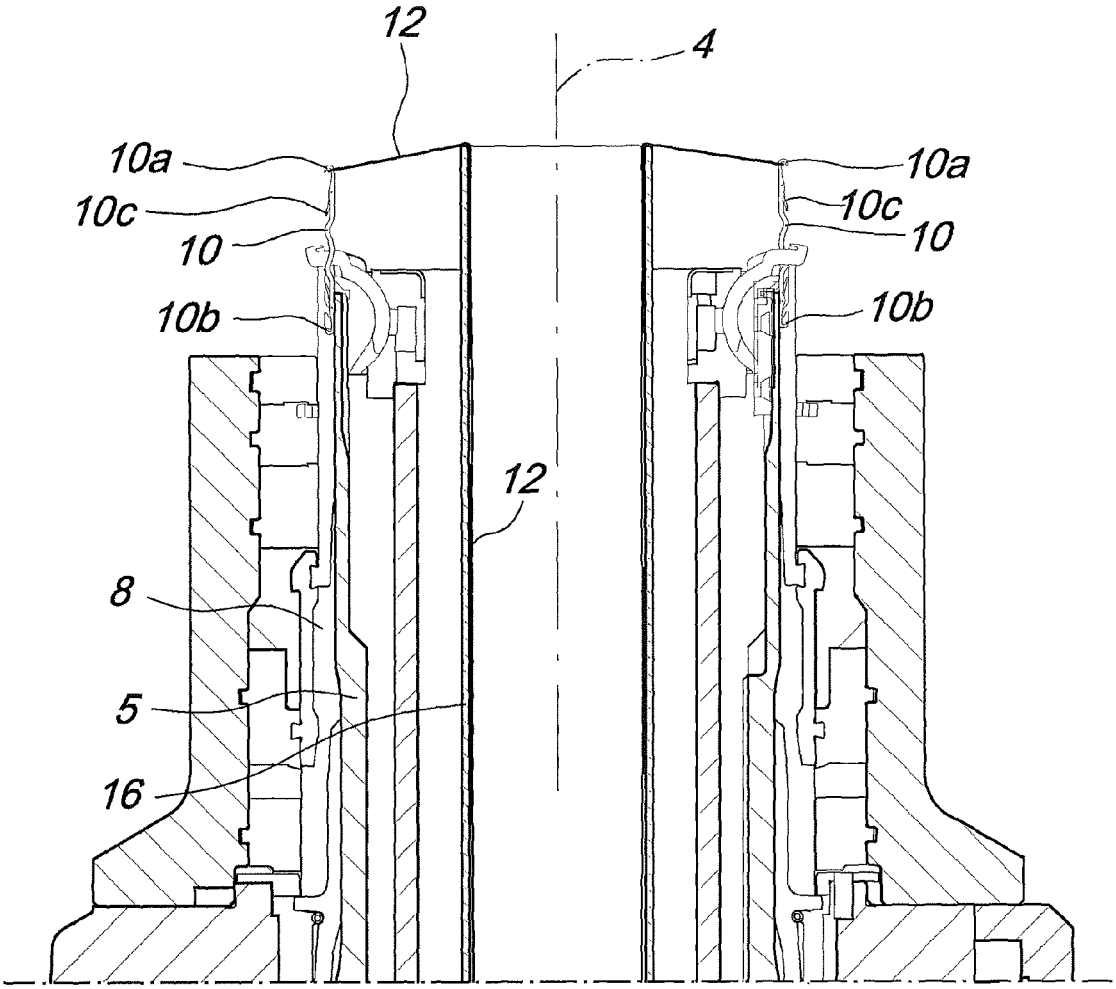
FIG. 8 is a view of the same detail as FIG. 7, with the manufacture in the position for pick-up from the needles of the machine, after the upper needle cylinder has been spaced from the lower needle cylinder.

More particularly, the suction tube 16 can be raised, thanks to the actuation of the motor 21, so as to protrude with its upper end from the upper end of the lower needle cylinder 5, in order to lift the last formed row of knitting, still engaged with the needles 10, pushing and/or keeping the last row of knitting in the upper head 10*a* of the needles 10 during their lifting above the upper end of the lower needle cylinder 5, as shown in FIG. 8, thus preventing the loops of the last row of knitting from being able to descend below the upper latch 10*c* of the needles 10, below which the pick-up elements of the pick-up device must engage the stein of the needles 10 to then receive said loops of knitting.

After the manufacture 12 has been picked up from the needles 10, the suction tube 16 can be again placed with its upper end inside the lower needle cylinder 5, so that it can be used in the formation of a new manufacture 12 and so as to allow the transition of the upper needle cylinder to the working position.

In practice it has been found that the machine with the manufacture tensioning device according to the invention fully achieves the intended aim, since it allows to arrange the manufacture inside the lower needle cylinder while it is still coupled to the needles of the machine in a position that is suitable for subjecting it to an automated pick-up operation.

Moreover, the tensioning device of the machine according to the invention allows to keep or move the loops of the last row of knitting formed by the needles in the upper head of said needles so that they can be picked up in an automated manner by pick-up elements that can engage the stem of the needles below the upper latch.

The machine with manufacture tensioning device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art. The disclosures in Italian Patent Application No. MI2011A001686 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A double-cylinder circular hosiery knitting machine, comprising a supporting structure which is provided with a footing for resting on supports, so as to allow rotation about a vertically oriented axis, a lower needle cylinder and an upper needle cylinder located, during the production of a product, above and coaxially with respect to said lower needle cylinder; said lower needle cylinder and said upper needle cylinder being actuatable with a rotary motion about the respective axes; a device for tensioning the product during its production being accommodated inside said needle cylinders; said device for tensioning the product comprising means for retaining the product proximate to the region where knitting is formed by needles accommodated in said needle cylinders and a tensioning tube, which is accommodated in said upper needle cylinder and is movable on command along an axis of said upper needle cylinder; a lower end of said tensioning tube being engageable, by sliding along the axis of said upper needle cylinder, with the product being formed that lies from said retention means to the needles; said retention means having a size suitable to allow the movement of said tensioning tube about said retention means, means for the translational motion of said tensioning tube along the axis of said upper needle cylinder being provided, wherein said retention means comprise a suction tube, which is accommodated internally and coaxially to said lower needle cylinder, and an element for locking the product, which faces an upper end of said suction tube and is supported by said upper needle cylinder, said locking element being movable on command along the axis of said upper needle cylinder to engage or disengage the upper end of said suction tube.

2. The machine according to claim 1, wherein said suction tube is supported so that it can slide along its own axis by said lower needle cylinder, means being provided for the translational motion of said suction tube along its own axis with respect to said lower needle cylinder.

3. The machine according to claim 1, wherein said suction tube is movable along its own axis with respect to said lower needle cylinder from a lowered position, in which it is arranged so that an upper end of the suction tube lies below the upper end of said lower needle cylinder, to a raised position, in which it protrudes with the upper end of the suction tube from the upper end of said lower needle cylinder, and vice versa.

4. The machine according to claim 1, wherein said suction tube protrudes, with its lower end, from the lower end of said lower needle cylinder; said suction tube being connected, at a portion thereof that protrudes from the lower end of the lower needle cylinder, to a sleeve; said suction tube being rotatable about its own axis with respect to said sleeve; said means for the translational motion of the suction tube comprising an electric motor, which is actuatable on command and is connected, by its shaft, to said sleeve by means of a connection of the screw-and-nut type whose axis is parallel to the axis of said suction tube.

5. The machine according to claim 1, wherein said tensioning tube is accommodated coaxially and slidingly within a guiding cylinder which is fixed coaxially inside said upper needle cylinder; said tensioning tube being connected, so as to be able to rotate about its own axis, to a block, which is movable along a direction which is parallel to the axis of said upper needle cylinder; said means for the translational motion of the tensioning tube comprising a first fluid-operated cylinder, which is connected by means of its body to said supporting structure and is connected to said block by the stem of a piston of the first fluid-operated cylinder, which is oriented parallel to the axis of said upper needle cylinder; said first fluid-operated cylinder being suppliable with a pressurized fluid in order to actuate the movement of said block parallel to the axis of said upper needle cylinder in order to lift or lower said tensioning tube along the axis of said upper needle cylinder.

6. The machine according to claim 1, further comprising means for detecting the movement of said tensioning tube along the axis of said upper needle cylinder.

7. The machine according to claim 6, wherein said detection means comprises a toothed belt which mutually connects two pulleys which are supported, so as to be able to rotate about their corresponding axes, which are oriented parallel to each other and at right angles to the axis of said upper needle cylinder by said supporting structure; said toothed belt being connected, with a portion that lies between said two pulleys, to said block and one pulley of said two pulleys being connected to an encoder for detecting its rotation.

8. The machine according to claim 1, wherein said locking element is connected to a lower end of a shaft which is arranged internally and coaxially to said upper needle cylinder and is supported so as to be able to slide along its own axis by said upper needle cylinder; said shaft being connected, by means of an upper end thereof, to a stem of the piston of a second fluid-operated cylinder which is associated with said supporting structure of the machine above the upper needle cylinder and is operable to actuate a translational motion of said shaft along the axis of said upper needle cylinder with respect to said upper needle cylinder; said shaft being able to rotate about its own axis jointly with the upper needle cylinder with respect to the stem of said second fluid-operated cylinder.

* * * * *